US010674272B2

(12) United States Patent
Hu et al.

(10) Patent No.: US 10,674,272 B2
(45) Date of Patent: Jun. 2, 2020

(54) SPEAKER

(71) Applicant: AAC Technologies Pte. Ltd., Singapore (SG)

(72) Inventors: Hongjian Hu, Shenzhen (CN); Shuai Li, Shenzhen (CN); Min Su, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,193

(22) Filed: Jul. 29, 2019

(65) Prior Publication Data

US 2020/0045433 A1 Feb. 6, 2020

(30) Foreign Application Priority Data

Aug. 1, 2018 (CN) ..... 2018 2 1236982 U

(51) Int. Cl.
*H04R 7/20* (2006.01)
*H04R 9/02* (2006.01)

(52) U.S. Cl.
CPC ..... *H04R 7/20* (2013.01); *H04R 9/025* (2013.01)

(58) Field of Classification Search
CPC ..... H04R 2209/00; H04R 2307/00; H04R 2400/00; H04R 2400/07; H04R 2400/11; H04R 2499/00; H04R 2499/10; H04R 2499/11
See application file for complete search history.

(56) References Cited

U.S. PATENT DOCUMENTS

2011/0075880 A1* 3/2011 Kamimura ..... H04R 1/06 381/413
2018/0302722 A1* 10/2018 Linghu ..... H04R 9/06

* cited by examiner

*Primary Examiner* — Walter F Briney, III
(74) *Attorney, Agent, or Firm* — W&G Law Group LLP

(57) ABSTRACT

Provided is a speaker, including a holder, a vibration unit and a magnetic circuit unit, and a holder pad. The vibration unit includes a first diaphragm, a voice coil configured to drive the first diaphragm to vibrate and emit sound, and a flexible circuit board. The holder includes a bottom surface facing away from the first diaphragm, and the flexible circuit board is fixed to the bottom surface. The holder pad is arranged correspondingly to the flexible circuit board and sandwiched between the bottom surface and the flexible circuit board. The holder pad includes a first pad electrically connected to the flexible circuit board, a second pad exposed out of the holder, and a connection portion connecting the first pad with the second pad. The first pad is electrically conducted with the second pad, and the second pad is connected to an external circuit.

9 Claims, 5 Drawing Sheets

SPEAKER

TECHNICAL FIELD

The present disclosure relates to the field of acoustic-electrical conversion, and in particular, to a speaker for a portable electronic product.

BACKGROUND

With the rapid development of technologies, audio devices become more and more popular, and among numerous recreation modes, high-quality music enjoyment is gradually popularized. Thus, speakers for playing audio have been widely applied to existing smart mobile devices.

The speaker in the related art includes a holder and a vibration unit and a magnetic circuit unit that are fixedly held at the holder. The vibration unit includes a first diaphragm, a voice coil located below the first diaphragm and configured to drive the first diaphragm to vibrate and emit sound, and a flexible circuit board located below the voice coil and configured to support the voice coil. The flexible circuit board is arranged at the lower end of the voice coil, connected to the voice coil with its inner edge, and fixedly connected to a short edge side wall of the holder with its outer edge. When such design is adopted, in order to avoid contact a connection arm of the flexible circuit board, a size of a main magnet needs to be reduced, which seriously limits the size of the main magnet and influence a sensitivity of a magnetic circuit unit of the speaker.

Therefore, it is urgent to provide a novel speaker so as to overcome the above defects.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

Figure 1:
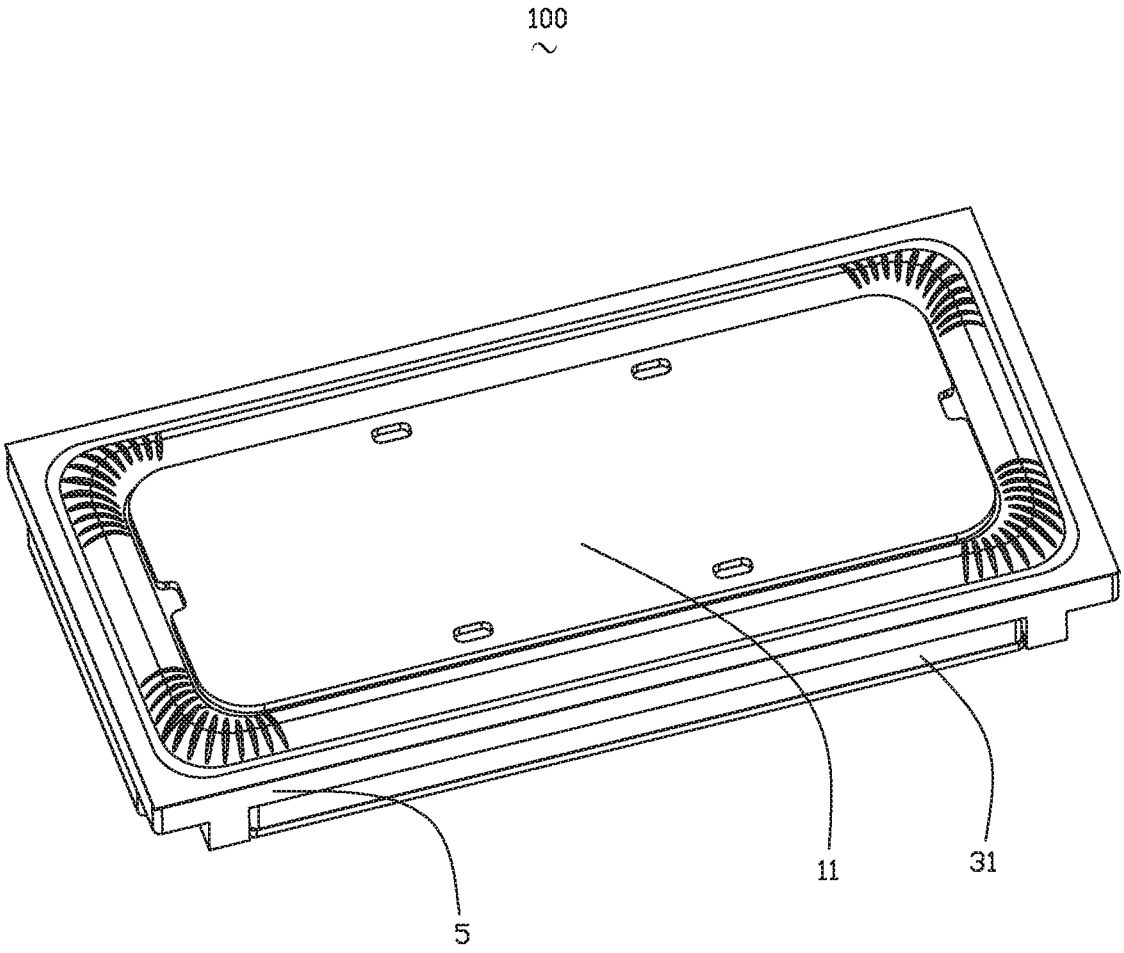
FIG. 1 is a perspective structural schematic diagram of a speaker according to the present disclosure.
Figure 2:
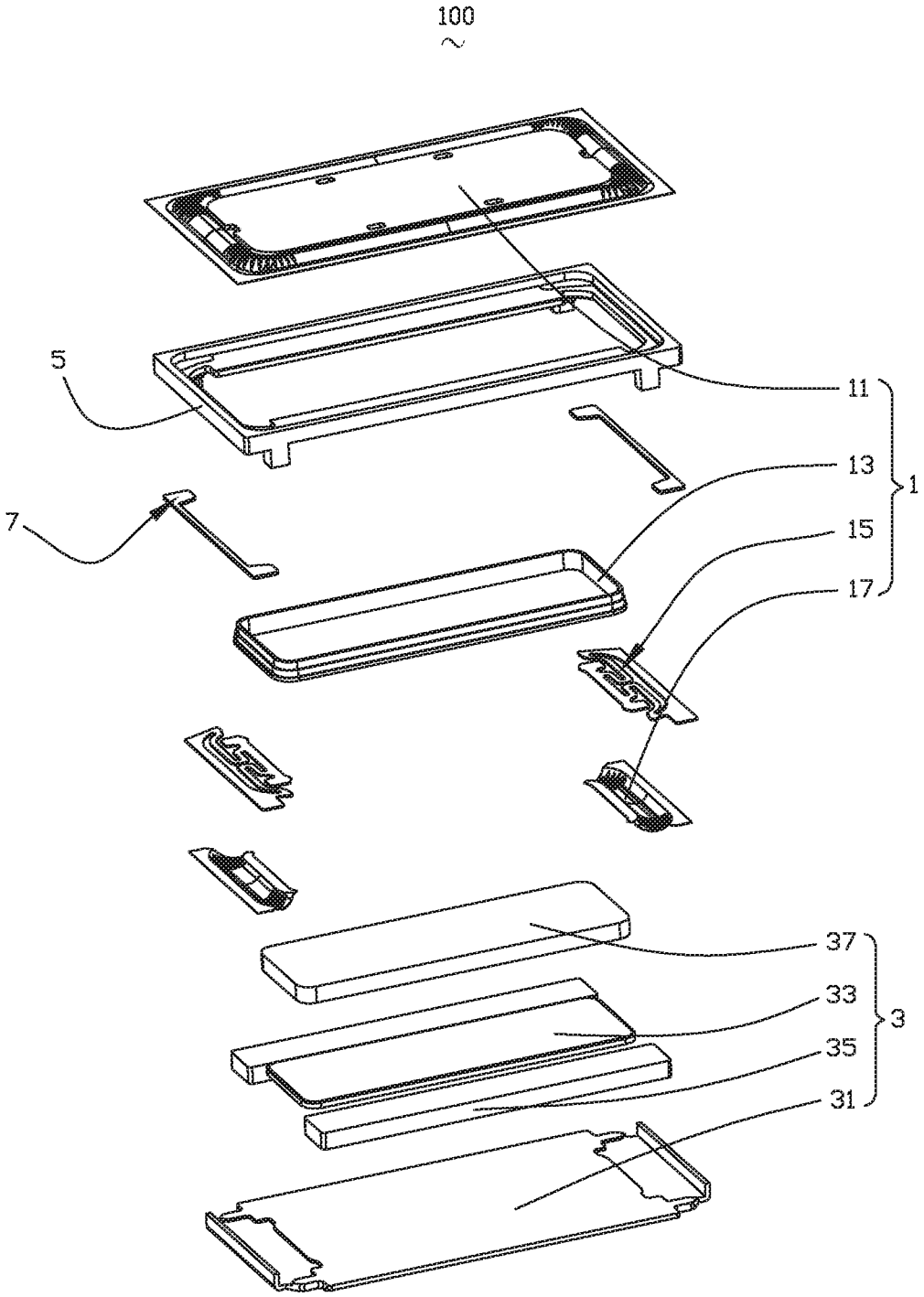
FIG. 2 is a perspective exploded structural schematic diagram of the speaker as shown in FIG. 1.
Figure 3:
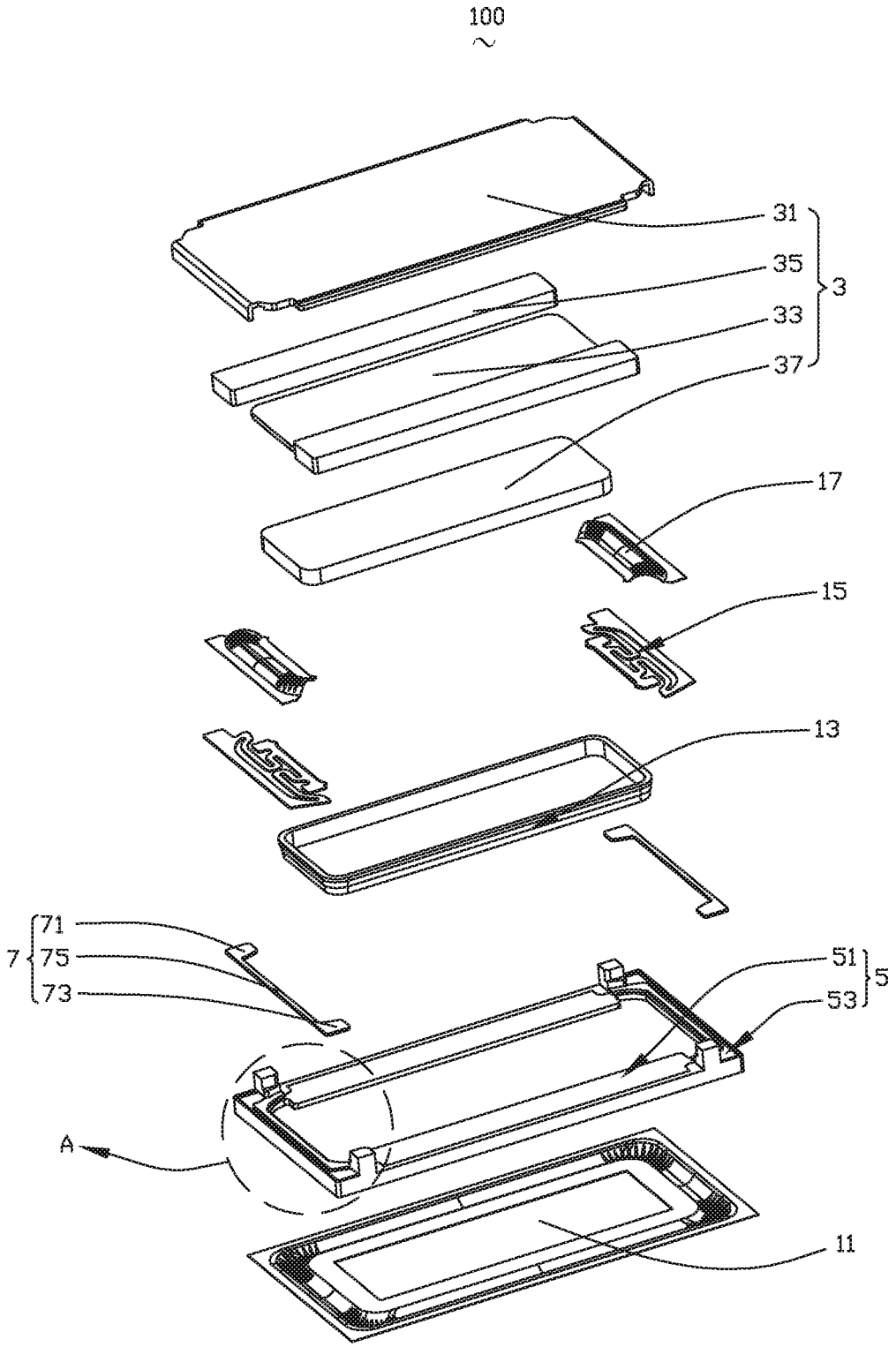
FIG. 3 is a perspective exploded structural schematic diagram of the speaker taken as shown in FIG. 2 from another angle.
Figure 4:
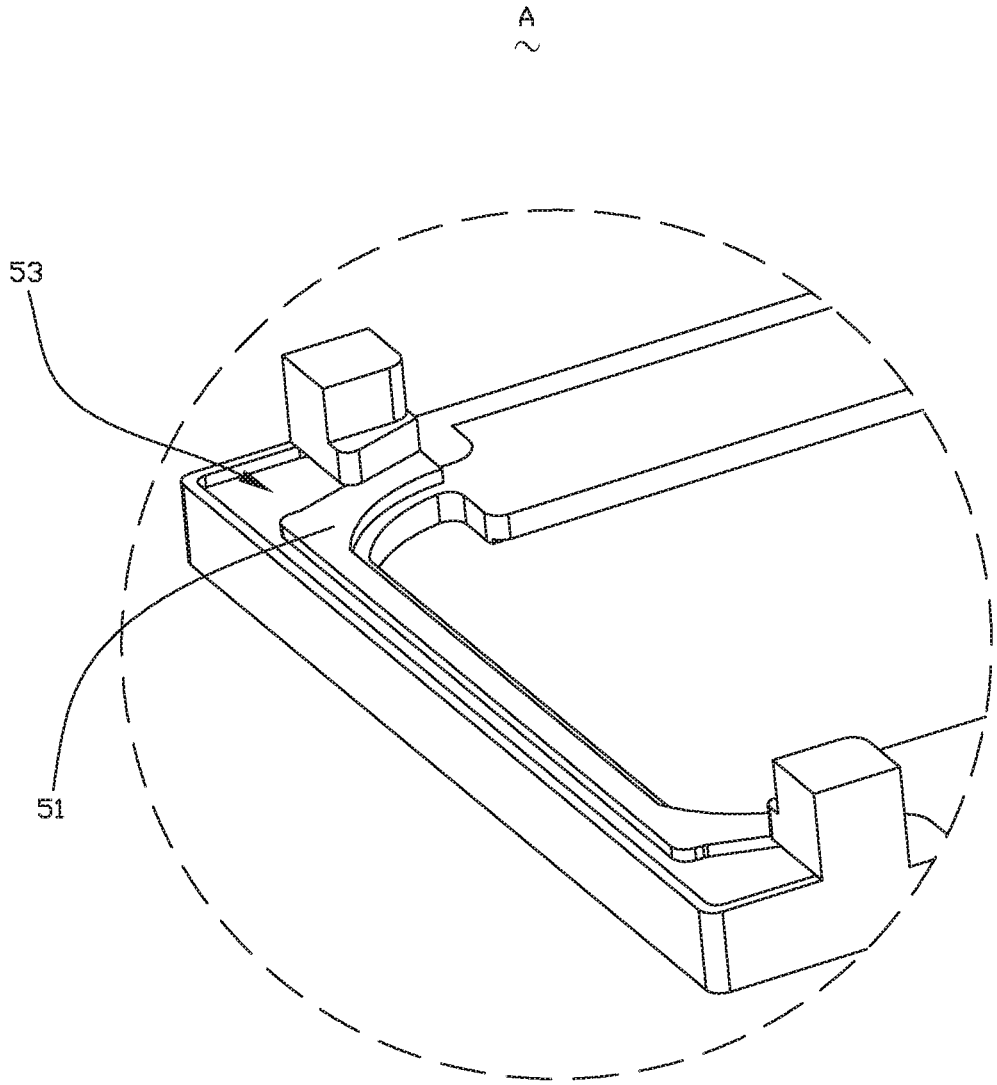
FIG. 4 is an enlarged view of Part A of the speaker as shown in FIG. 3.

The present disclosure will be further illustrated with reference to the accompanying drawings and the embodiments.

With reference to FIG. 1 to FIG. 4, a speaker 100 includes a vibration unit 1, a magnetic circuit unit 3 for driving the vibration unit 1 to vibrate and emit sound, a holder 5 for fixing and holding the vibration unit 1 and the magnetic circuit unit 3, and a holder pad 7 fixedly connected to the holder 5.

The vibration unit 1 includes a first diaphragm 11, a voice coil 13 located on a side of the first diaphragm 11 and configured to drive the first diaphragm 11 to vibrate and emit sound, flexible circuit boards 15 located at an end of the voice coil 13 facing away from the first diaphragm 11, and second diaphragms 17 arranged correspondingly to the flexible circuit boards 15. The second diaphragm 17 is fixedly arranged on a side of the flexible circuit board 15 facing away from the first diaphragm 11, and the second diaphragms 17 and the flexible circuit boards 15 are assembled to elastically support the voice coil 13. In this embodiment, two circuit boards 15 are provided, and correspondingly, there are also two second diaphragms 17.

The first diaphragm 11 vibrates and emit sound under the drive of the voice coil 13 and converts an electric signal into an acoustical signal.

Figure 5:
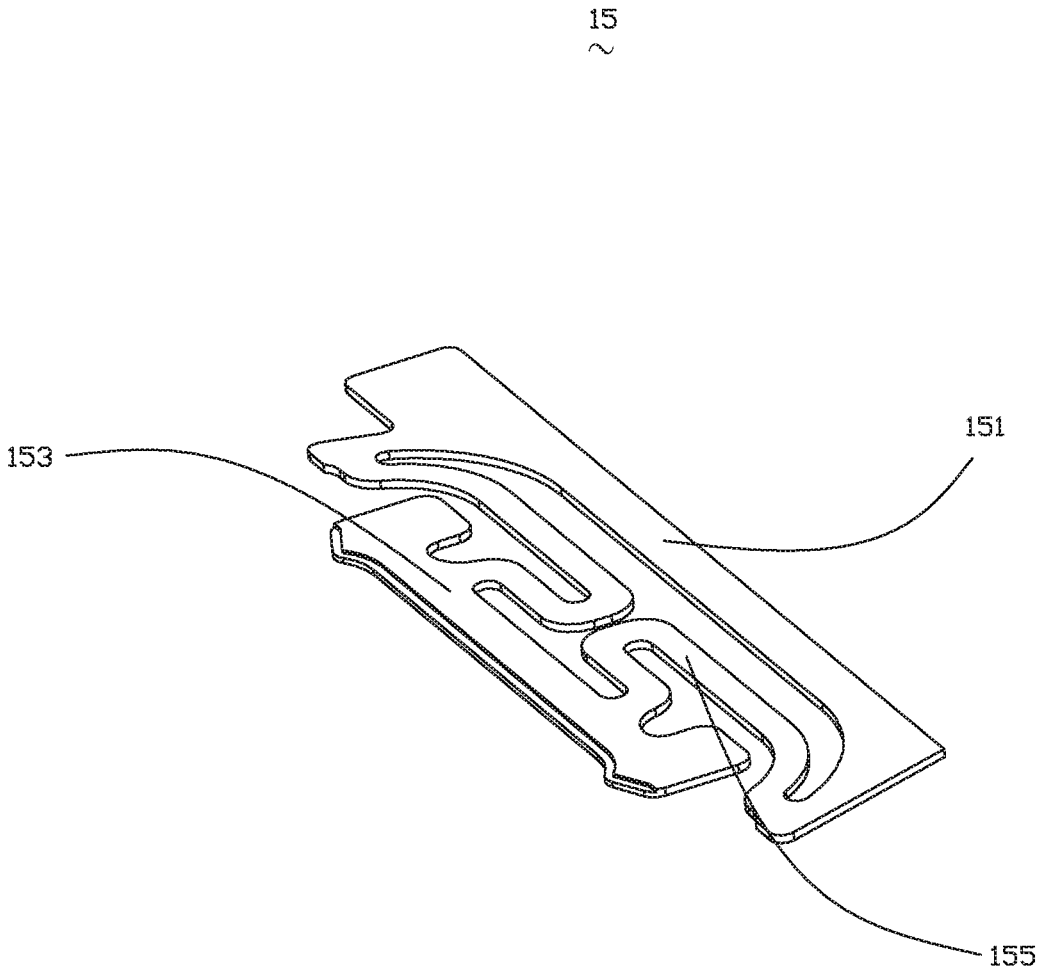
FIG. 5 is a structural schematic diagram of a flexible circuit board of the speaker as shown in FIG. 3.

With reference to FIG. 5, the flexible circuit board 15 includes a first fixed portion 151 electrically connected to the voice coil 13, a second fixed portion 153 fixed to the holder 5 and spaced apart from the first fixed portion 151, and an elastic portion 155 connecting the first fixed portion 151 with the second fixed portion 153.

The second diaphragm 17 and the flexible circuit board 15 are arranged in one-to-one correspondence, and the two second diaphragms 17 are arranged on sides of the two flexible circuit boards 15 facing away from the first diaphragm 11, respectively. The second diaphragm 17 is fixedly connected to the flexible circuit board 15 though an adhesive. The second diaphragm 17 and the flexible circuit board 15 match mutually, which, on the one hand, intensifies a vibration effect of the first diaphragm 11, and on the other hand, prevent a polarization of the voice coil 13.

The magnetic circuit unit 3 includes a yoke 31 fixed to the bottom surface of the holder 5, a main magnet 33 directly facing the first diaphragm 11 and fixed to the yoke 31, auxiliary magnets 35 spaced apart from the main magnet 33 and fixed to the yoke 31, and a main pole plate 37 attached to the main magnet 33.

A magnetic gap is formed between the main magnet 33 and the auxiliary magnet 35, the voice coil 13 extends into the magnetic gap. Two auxiliary magnets 35 are provided, and the two auxiliary magnets 35 are symmetrically arranged at two sides of the main magnet 33 along a length direction of the holder 5.

The holder 5 is of a rectangular frame-shaped structure. The holder 5 includes a bottom surface 51 facing away from the first diaphragm 11 and a groove 53 formed by recessing from the bottom surface 51 towards the first diaphragm 11, and the holder 5 is fixed to the flexible circuit board 15 with the bottom surface 51.

For example, the holder pad 7 is fixed on the bottom surface 51 and arranged correspondingly to the flexible circuit board 15, and the holder pad 7 is sandwiched between the bottom surface 51 and the flexible circuit board 15.

Further for example, the holder pad 7 is received and fixed in the groove 53, and a thickness of the holder pad 7 is not smaller than a recessed depth of the groove.

The holder pad 7 includes a first pad 71 electrically connected to the flexible circuit board 15, a second pad 73 exposed out of the holder 5, and a connection portion 75 connecting the first pad 71 with the second pad 73. The first pad 71 is electrically conducted with the second pad 73, and the second pad 73 is connected to an external circuit.

For example, the first pad 71 and the flexible circuit board 15 can be fixed by a Hot-Bar process.

The first pad 71 and the connection portion 75 are sandwiched between the second fixed portion 153 and the bottom surface 51. In other words, the second fixed portion 153 is arranged to cover a side of the first pad and a side of the connection portion 75, which face away from the groove 53, and to avoid the second pad 73.

The second fixed portion 153 is electrically connected to the first pad 71 by welding at a position corresponding to the first pad 71.

A conductive path electrically conducting the first pad 71 with the second pad 73 is provided in the connection portion 75 and is insulated from the second fixed portion 153.

For example, two holder pads 7 are provided, and the two holder pads 7 are arranged at four corners of the holder 5 along a width direction of the holder 5. The first pad 71 and the second pad 73 disposed on one side of the holder 5 are symmetrically arranged about the central axis of the width direction of the holder 5.

Compared to the related art, in the speaker 100 provided by the present disclosure, the connection between the flexible circuit board 15 and the holder 5 is a novel connection mode. For example, the holder pad 7 is arranged at the bottom end of the holder 5, the holder pad 7 includes the first pad 71 electrically connected to the flexible circuit board 15, the second pad 73 exposed out of the holder 5 and the connection portion 75 connecting the first pad 71 with the second pad 73, the first pad 71 is connected to the second pad 73, and the second pad 73 is connected to the external circuit. By adopting such design, the occupied space of the holder 5 is reduced so that performance of the speaker 100 can be enhanced by lengthening the magnet.

The above are merely embodiments of the present disclosure, and it should be noted that those skilled in the art can make improvements without departing from the inventive concept of the present disclosure, however, these improvements shall belong to the protection scope of the present disclosure.

What is claimed is:

1. A speaker, comprising:

a holder;

a vibration unit fixedly held at the holder;

a magnetic circuit unit fixedly held at the holder; and a holder pad, wherein the vibration unit comprises:

a first diaphragm;

a voice coil located on a side of the first diaphragm and configured to drive the first diaphragm to vibrate and emit sound; and a flexible circuit board located at an end of the voice coil facing away from the first diaphragm, the holder comprises a bottom surface facing away from the first diaphragm, and the flexible circuit board is fixed to the bottom surface, the holder pad is fixed to the bottom surface and arranged correspondingly to the flexible circuit board, the holder pad is sandwiched between the bottom surface and the flexible circuit board, and the holder pad comprises:

a first pad electrically connected to the flexible circuit board;

a second pad exposed out of the holder; and a connection portion connecting the first pad with the second pad, wherein the first pad is electrically conducted with the second pad, and the second pad is connected to an external circuit.

2. The speaker as described in claim 1, wherein the first pad and the flexible circuit board are fixed by a Hot-Bar process.

3. The speaker as described in claim 1, wherein the holder further comprises a groove formed by recessing from the bottom surface towards the first diaphragm, and the holder pad is received and fixed in the groove.

4. The speaker as described in claim 3, wherein the flexible circuit board further comprises:

a first fixed portion electrically connected to the voice coil;

a second fixed portion fixed to the bottom surface and spaced apart from the first fixed portion; and an elastic portion connecting the first fixed portion with the second fixed portion, wherein the second fixed portion is arranged to cover a side of the first pad and a side of the connection portion that face away from the groove, and to avoid the second pad.

5. The speaker as described in claim 4, wherein a position of the second fixed portion, which corresponds to the first pad, is electrically connected to the first pad by welding, and a conductive path configured to electrically conduct the first pad with the second pad is provided in the connection portion and is insulated from the second fixed portion.

6. The speaker as described in claim 4, wherein the holder is of a rectangular frame-shaped structure, two holder pads are provided, the two holder pads are arranged on two opposite sides of the holder along a width direction of the holder, two first pads and two second pads are respectively arranged on four corners of the holder, and one of the two first pads and one of the two second pads that are disposed on one of the two opposite sides of the holder are symmetrically arranged about a central axis of the width direction of the holder.

7. The speaker as described in claim 6, wherein the magnetic circuit unit comprises:

a yoke fixed to the bottom surface of the holder;

a main magnet directly facing the first diaphragm and fixed to the yoke; and auxiliary magnets spaced apart from the main magnet and fixed to the yoke, wherein a magnetic gap is formed between the main magnet and each of the auxiliary magnets, the voice coil extends into the magnetic gap, and the auxiliary magnets are symmetrically arranged on two sides of the main magnet along a length direction of the holder.

8. The speaker as described in claim 3, wherein a thickness of the holder pad is larger than or equal to a recessed depth of the groove.

9. The speaker as described in claim 1, wherein the vibration unit further comprises two second diaphragms respectively arranged correspondingly to two flexible circuit boards, the two second diaphragms are fixedly arranged on sides of the two flexible circuit board facing away from the first diaphragm, and the two second diaphragms and the two flexible circuit boards are assembled to elastically support the voice coil.

* * * * *